United States Patent [19]

Smith

[11] Patent Number: 5,040,957

[45] Date of Patent: Aug. 20, 1991

[54] CO-ROTOR ENGINE WITH VALVE SYSTEM

[76] Inventor: Russel I. Smith, 3055 Kincaid, Eugene, Oreg. 97405

[21] Appl. No.: 525,997

[22] Filed: May 21, 1990

[51] Int. Cl.[5] ..... F01C 21/12

[52] U.S. Cl. ..... 418/34; 418/161; 418/188

[58] Field of Search ..... 418/34, 35, 37, 161, 418/188

[56] References Cited

U.S. PATENT DOCUMENTS

| | | | |
|---|---|---|---|
| 562,152 | 6/1896 | Prall | 418/34 |
| 830,124 | 9/1906 | Weeks | 418/35 |
| 915,296 | 3/1909 | Holloway | 418/34 |
| 3,227,090 | 1/1966 | Bartolozzi | 418/35 |
| 4,127,367 | 11/1979 | Smith | 418/35 |
| 4,666,379 | 5/1987 | Smith | 418/35 |

*Primary Examiner*—Leonard E. Smith
*Assistant Examiner*—David L. Cavanaugh
*Attorney, Agent, or Firm*—Kolisch, Hartwell, Dickinson, McCormack & Heuser

[57] ABSTRACT

A co-rotor engine with an internal valving system controlling the supply to and exhaust from motor chambers of gas under pressure. The valving system has concentric sleeves that are relatively displaced in performing the valving function.

6 Claims, 2 Drawing Sheets

FIG. 1
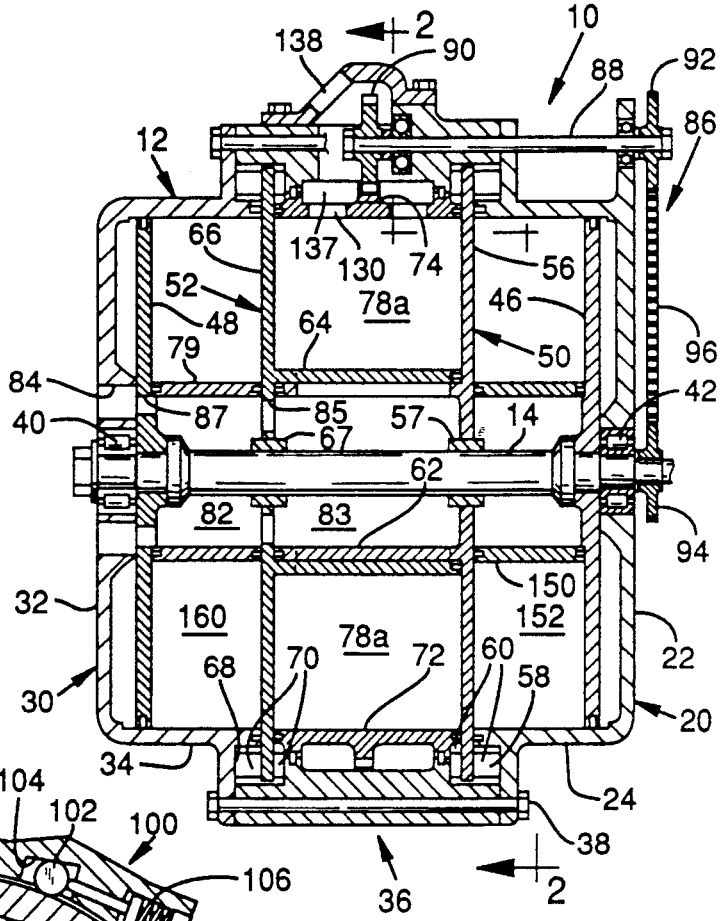
FIG. 2
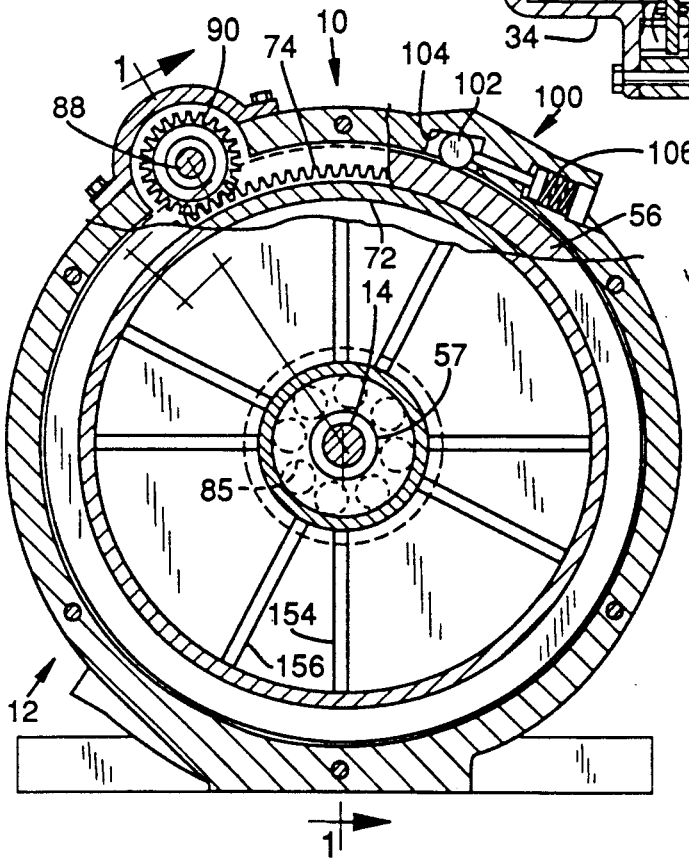
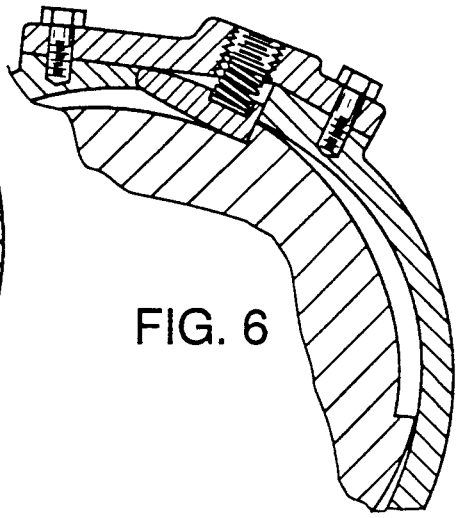
FIG. 6

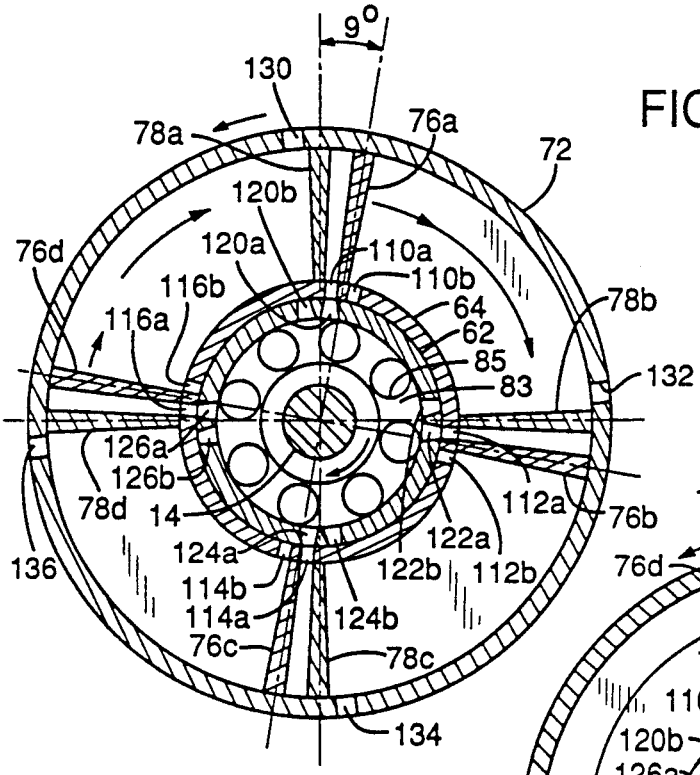
FIG. 3
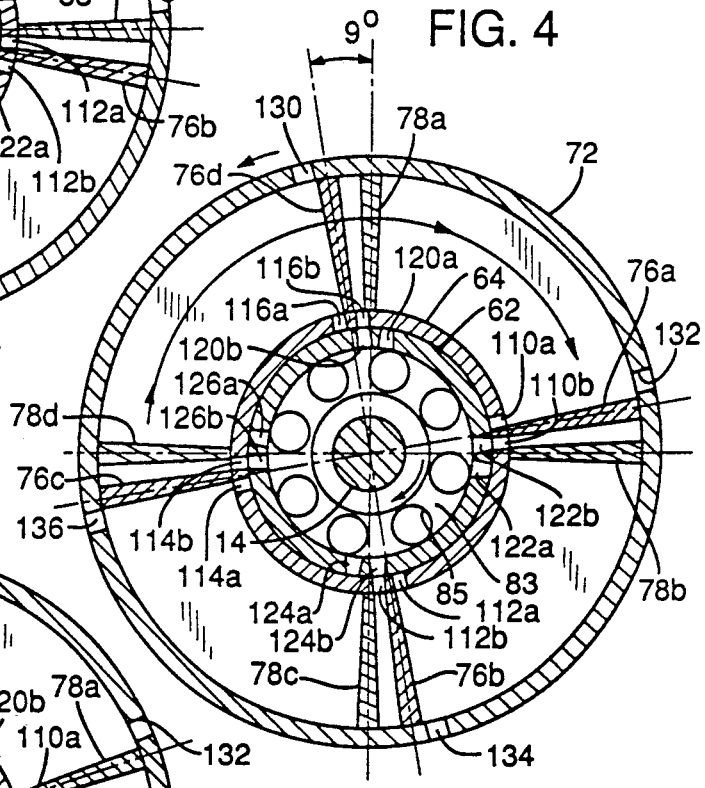
FIG. 4
FIG. 5
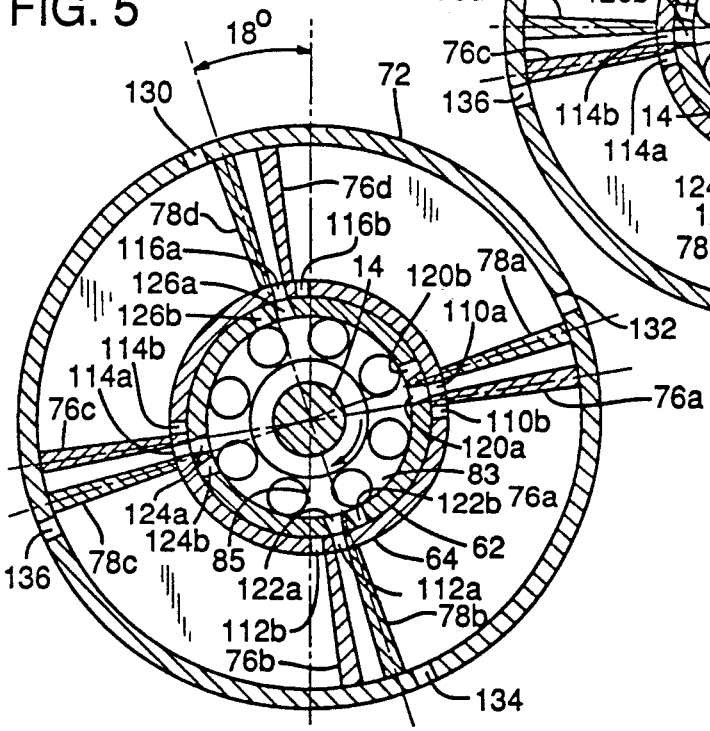

CO-ROTOR ENGINE WITH VALVE SYSTEM

This invention relates to a co-rotor engine and a valving system for the engine whereby gas under pressure in a controlled manner is admitted and exhausted from motor chambers defined between rotors in the engine.

In prior issued U.S. Pat. Nos. 4,127,367 and 4,666,379, there are disclosed co-rotor engines including a pair of rotor members with motor chambers defined between vanes of these members. The rotor members are coupled to an engine shaft in such a manner that with movement produced in the rotor members, such movement is imparted to the shaft. The rotor members are caused to be rotated under power through the controlled admission to and exhaust from the motor chambers described of gas under pressure. The instant invention concerns a valve system which may be employed in this controlled admission and exhaust of pressure fluid to and from these motor chambers.

Included within the objects of this invention is the provision, in combination with a co-rotor engine as above generally described, of novel valve means working in conjunction with the rotor members to produce controlled admission and exhaust of pressure fluid, i.e., gas under pressure, producing rotation of the rotor members.

Another object of the invention is to provide such a valve system wherein the admission of pressure fluid to motor chambers is controlled by internally positioned concentric sleeves.

Another object is to provide a co-rotor engine with concentric sleeves performing the required valving function and wherein these sleeves may be an integral part of respective rotors in the co-rotor engine.

These and other objects and advantages are attained by the invention, which is described hereinbelow in conjunction with the accompanying drawings, wherein:

FIG. 1 is a sectional view of the co-rotor engine, taken generally along a plane which contains the output shaft in the engine.

FIG. 2 is a cross-sectional view, taken generally along the line 2—2 in FIG. 1;

FIGS. 3, 4, and 5 are simplified cross-sectional views, illustrating paired rotor members in the engine with the rotor members in different positions, and the valving means which is operative to admit and exhaust fluid under pressure; and FIG. 6 is similar to portions of FIG. 2, but showing a modification.

Referring now to the drawings, the co-rotor engine in FIGS. 1 and 2 is indicated generally at 10. The engine includes a casing 12, and rotatably supported within the casing an output shaft 14.

Casing 12 includes an end section 20 having an end wall 22 and integral with this end wall is a cylindrical skirt 24. Opposite end section 20 is another end section 30 with an end wall 32 and integral skirt 34. Interposed between these two end sections is a hollow intermediate section 36. The end sections and the intermediate sections are suitably joined together, as with the nut and bolt assembly, or fastener, shown at 38.

Bearings 40, 42 rotatably mount shaft 14 in end walls 22, 32 of the casing. Secured to the output shaft to rotate with the shaft, and disposed inwardly of the bearings 40, 42 are disc-shaped end plates 46, 48. Inwardly of these end plates, and rotatably supported within casing 12, are a pair of rotatable vaned rotor members or elements designated generally at 50 and 52. Each will be described in detail.

Considering rotor element 50, the element includes a disc-shaped rotor plate 56 relatively rotatably supported by bearing 57 on output shaft 14. The perimeter of the rotor plate rides within an annular channel 58 defined between intermediate section 36 and end section 20 of the casing. Maintaining the plate positioned, and engaging opposite sides of the rotor plate, are bearings 60.

Joined to rotor plate 56 is what is referred to as an inner concentric sleeve 62 concentric with shaft 14. Relatively rotatably supported on inner concentric sleeve 62 is an outer concentric sleeve 64. These sleeves are part of valve means controlling the admission of fluid under pressure to the engine.

Sleeve 64 is secured at one end to a disc-shaped rotor plate 66. The peripheral margin of plate 66 rides within an annular channel 68 which is defined between end section 30 of the casing and intermediate section 36. Rotatably supporting this peripheral margin within channel 68 are bearings 70. Bearing 67 rotatably supports plate 66 on shaft 14.

The end of sleeve 62 which is adjacent plate 66 sealingly engages the plate. The end of sleeve 64 which is adjacent plate 56 sealingly engages the plate. Arranged concentrically with inner and outer sleeves 62, 64 is a cylinder 72. Ends of this cylinder sealingly engage opposed inwardly facing faces of rotor plates 56, 66. Extending about the exterior of this cylinder is a ring gear 74. The ring gear and cylinder are integrally joined.

Outer concentric sleeve 64, the two rotor plates 56, 66, and cylinder 72 bound an annular space extending about output shaft 14. Extending into this space, and as probably best illustrated in FIGS. 3 through 5, are a set of equally circumferentially spaced motor vanes 76*a*, 76*b*, 76*c*, and 76*d*. These are secured to rotor plate 66 which, it will be remembered, is joined to and an integral part of outer sleeve 64. Interspersed with these vanes are a series of equally circumferentially spaced vanes 78*a*, 78*b*, 78*c*, and 78*d* which are secured to rotor plate 56 which, it will be remembered, is secured to and part of inner concentric sleeve 62. Plate 56 and its vanes 78*a* through 78*d* constitute rotor element 50, whereas plate 66 and its vanes 76*a* through 76*d* constitute rotor element 52.

Defined between the interspersed vanes of the two rotor elements are what are referred to herein as motor chambers circumferentially distributed about the output shaft 14.

Shown at 79 is a sleeve with opposite ends sealingly engaging end plate 48 and rotor plate 66. Between output shaft 14 and sleeve 79, is an annular passage 82. This passage connects, through ports 85 in rotor plate 66, with a passage 83 defined between sleeve 62 and output shaft 14.

Gas under pressure supplied to ports 84 in end wall 32 is admitted to passage 83 by flowing through ports 87 in end plate 48 into passage 82 and thence through ports 85 to be introduced to passage 83.

With concentric sleeves 64, 62 being part of respective rotor elements, these sleeves rotate in timed relation with the rotor elements. Cylinder 72 also rotates in timed relation with the rotor elements and the output shaft, by reason of gearing 86 which connects the output shaft with the cylinder. Specifically, a shaft 88 is rotatably mounted on the casing, which has secured to one end a spur gear 90 engaging with the teeth of ring gear 74. The opposite end of this shaft mounts a sprocket 92. A sprocket 94 is drivingly connected to the output shaft. A toothed belt drivingly connects sprocket 92 and sprocket 94. With the gearing described, with rotation of the drive shaft in a clockwise direction in FIGS. 3 through 5, cylinder 72 is caused to rotate in the opposite direction, and at a substantially lower speed.

Illustrated at 100 in FIG. 2 is what is referred to as a reverse motion brake. One or more is provided each rotor element in the engine. The brake prevents rotation of the rotor element in a counterclockwise direction as the rotor element is viewed in FIGS. 3 through 5. The brake includes a ball 102 which may move within a tapered cavity 104 against the biasing of spring 106. With counterclockwise movement of a plate such as plate 56, the ball becomes wedged against the outer margin of the plate preventing rotation.

A modified form of reverse motion brake with a pawl and ratchet type of construction is shown in FIG. 6.

Ports are provided distributed circumferentially in the inner and outer sleeves 62, 64, which move in and out of registry with relative rotation of the sleeves, and which produce controlled admission of pressure fluid from passage 83 to the motor chambers defined between the vanes, whereby first one and then the other rotor element is caused to advance in controlled fashion to produce rotation of the output shaft. Ports in cylinder 72 provide for the exhaust of fluid under pressure from selected motor chambers as required to produce proper rotor advancement.

Specifically, and referring to FIGS. 3 through 5, outer concentric sleeve 64 which has motor vanes 76*a*, 76*b*, 76*c*, and 76*d* secured thereto, is provided with a port on each side of these vanes. Thus, ports 110*a*, 110*b* are provided on either side of vane 76*a*, ports 112*a*, 112*b* are provided on either side of vane 76*b*, ports 114*a*, 114*b* are provided on either side of vane 76*c*, and ports 116*a*, 116*b* are provided on either side of motor vane 76*d*. In connection with inner concentric sleeve 62 and the vanes connected to this sleeve, ports 120*a*, 120*b*, 122*a*, 122*b*, 124*a*, 124*b*, and 126*a*, 126*b* are provided.

Four circumferentially distributed ports are provided in cylinder 72, and these are shown at 130, 132, 134, and 136. These connect (and referring to FIG. 1), through chamber 137 and ports such as port 138 in the casing, with the atmosphere.

Explaining how the engine is actuated, and assuming the position of the parts as shown in FIG. 3, with gas such as air under pressure in passage 83, such is admitted to the motor chamber defined between vanes 78*a* and 76*a* through port 120*a* which registers with port 110*a*. The chamber between vanes 78*a* and 76*a* enlarges with the chamber between vane 76*a* and vane 78*b* diminishing in size as gas under pressure exits through port 132. A similar enlargement occurs with respect to the motor chamber between vanes 78*b* and 76*b*, 78*c* and 76*c*, and 78*d* and 76*d*. The outer concentric sleeve moves to reach to the position shown in FIG. 4, where vane 76*d* moves adjacent and behind vane 78*a*, and vane 76*a* moves adjacent and behind vane 78*b*. Cylinder 72 rotates in the opposite direction a distance sufficient to provide an exhaust passage in passage 132 behind newly positioned vane 76*a* and other vanes corresponding to it in rotor 52.

With the condition of the parts shown in FIG. 4 reached, pressurized gas is introduced to the motor chamber between adjacent vanes, utilizing now a passage in the outer sleeve which is directly in front of a vane attached to this sleeve (for instance, passage 116*b*), and a passage in the inner sleeve which is directly behind an associated vane (for instance, passage 126*b*). The rotor containing the inner sleeve, i.e., rotor 50, now advances until the position shown in FIG. 5 is reached. With the parts reaching the position illustrated in FIG. 5, the cylinder 72 and rotor elements 50, 52 have the same relative position as illustrated in FIG. 3.

As discussed in my earlier patent U.S. Pat. No. 4,666,379, rotary elements may be connected to the driven shaft whereby the rotary elements drive the shaft utilizing a fluid compression means associated with each. Thus, shown at 150 (see FIG. 1) is a sleeve concentric with the shaft 14 with opposite margins in substantial sealing engagement with end wall 46 and rotor plate 56, respectively. An annular chamber 152 is defined between sleeve 150, end wall 46, rotor plate 56, and the skirt 24 of end section 20. Within this chamber are interspersed power-transmitting vanes, with a set of vanes connected to plate 56 being interspersed with a set of vanes connected to end wall 46. In FIG. 2 representative vanes are illustrated at 154, 156 These produce a driving connection between rotor element 50 (which includes rotor plate 56) and the output shaft, in the same fashion as does the construction shown in my earlier patent. Similar sets of vanes connected to end wall 48, rotor plate 66 in annular chamber 160 defined at the opposite end of the engine provide for the transmission of drive from rotor element 52 to output shaft 14.

It should be apparent, obviously, that the number of vanes utilized in the rotor elements 50, 52 is subject to variation. With a different number of vanes in the rotor elements, and to have a valving system which operates as herein specifically described, then appropriate changes would be made in the interregistering ports provided in the concentric sleeves and with the exhaust ports provided in the adjustable outer cylinder 72.

It will be apparent that in the specific form of the invention herein illustrated, the valving system which provides for the introduction of gas under pressure to selected motor chambers is located internally of the engine, with movement in proper timed relation by reason of the fact that the valving instrumentality, i.e., the sleeves, are an integral part of the two rotors which are provided in the engine.

While specific forms of the invention have been herein discussed and disclosed, variations and modifications are possible without parting from the invention and such variations and modifications are embraced within the language of the appended claims.

It is claimed and desired to secure by Letters Patent:

1. In an engine that includes a casing, an output shaft relatively rotatably mounted in said casing, and a pair of rotatable vaned rotor elements in the casing operatively coupled to the output shaft whereby rotation of the vaned rotor elements is imparted tot he shaft, each vaned rotor elements having motor vanes that are interspersed with the motors vanes of the other element and motor chambers being defined between adjacent motor vanes, means to admit gas under pressure to alternate ones of said chambers and to exhaust gas from other alternate ones of said chambers, said means including valve means for first admitting gas under pressure to a chamber and then to exhaust gas from the chamber, said valve means including concentric sleeves with interregistering ports rotatable in timed relation with the rotor elements, a cylinder disposed about the vaned rotor elements having ports providing for the controlled exhaust of gas from said motor chambers, the cylinder being concentric with the concentric sleeves and rotatable in timed relation with the shaft.

2. The engine of claim 1, wherein said concentric sleeves include a pair of sleeves, one being secured to and rotating with one rotor element and the other being secured to and rotating with the other rotor element.

3. The engine of claim 2, wherein said pair of sleeves are concentric with the shaft and wherein a chamber for containing gas under pressure is defined between the shaft and the concentric sleeves and gas from the chamber is supplied through said interregistering ports to said motor chambers.

4. A co-rotor engine comprising:

a casing, a motor output shaft rotatably mounted in said casing, an inner concentric sleeve concentric with the shaft rotatably mounted within the casing and an outer concentric sleeve concentric with the shaft disposed about said inner concentric sleeve, a first vaned rotor element including a disc secured to said inner sleeve and vanes secured to and extending axially from the disc, a second vaned rotor element including a disc secured to said outer sleeve and vanes secured to the disc and extending axially of the sleeve, the vanes of the first rotor element being interspersed with the vanes of the second rotor element and motor chambers being defined between adjacent vanes, a chamber for holding gas under pressure defined between the shaft and the inner concentric sleeve, said sleeves having interregistering ports providing for valve-controlled flow of gas from said chamber into said motor chambers, and a cylinder encompassing said rotor elements concentric with the shaft and sleeves having ports communicating with the motor chambers providing for exhaust of gas from said chambers.

5. The engine of claim 4, which further includes gearing operatively interconnecting the output shaft and said cylinder producing rotation of said cylinder in timed relation with rotation of the shaft.

6. The engine of claim 5, wherein said interregistering ports include for each vane in the first rotor element ports distributed circumferentially on the inner sleeve on either side of the vane and for each vane in the second rotor element ports distributed cirumferentially on the outer sleeve on either side of the vane.

* * * * *